US005108317A

United States Patent [19]

Beinhaur et al.

[11] Patent Number: 5,108,317

[45] Date of Patent: Apr. 28, 1992

[54] SEALED METAL SHELL CONNECTOR AND METHOD OF MOLDING A PLASTIC INSERT WITHIN A METAL SHELL

[75] Inventors: Ernest L. Beinhaur; William E. McClusky, both of Harrisburg; Daryl L. Stoner, Rexmont, all of Pa.

[73] Assignee: AMP Incorporated, Harrisburg, PA

[21] Appl. No.: 674,858

[22] Filed: Mar. 21, 1991

[51] Int. Cl.[5] ..... H01R 13/405

[52] U.S. Cl. ..... 439/736; 29/841; 264/274

[58] Field of Search ..... 439/736; 29/841, 843; 264/274; 174/522, 163 R

[56] References Cited

U.S. PATENT DOCUMENTS

| | | | |
|---|---|---|---|
| 3,207,832 | 9/1965 | Patti et al. | 264/272 |
| 3,491,441 | 1/1970 | Belsaas | 29/883 |
| 3,520,990 | 7/1970 | Boersma | 264/274 X |
| 3,562,696 | 2/1971 | Barnhart et al. | 339/60 |
| 3,904,265 | 9/1975 | Hollyday et al. | 339/103 M |
| 4,457,576 | 7/1984 | Cosmos et al. | 339/143 R |
| 4,480,151 | 10/1984 | Dozier | 174/153 R |
| 4,808,125 | 2/1989 | Waters et al. | 439/607 |
| 4,874,336 | 10/1989 | Marsh | 439/607 |

OTHER PUBLICATIONS

AMP Catalog 73-187, "Box Contact Connectors" 08/89; pp. 1,2,48,59.

Cinch Catalog C-50A, "Dura-Con Connectors" (date unknown); pp. 23-26; Cinch Connector Division, Labinal Components and Systems, Inc.

*Primary Examiner*—Eugene F. Desmond

*Attorney, Agent, or Firm*—Anton P. Ness

[57] ABSTRACT

An article such as an electrical connector (10) formed by molding a plastic septum (50) transversely across an axially extending cavity (22) through a metal shell (20) and about the array of contacts (60) extending axially within the axial shell cavity (22). The metal shell (20) includes a peripheral flange (34) around the inner surface (30) axially at the location (32) of the plastic septum (50), and upon curing and cooling the plastic septum includes portions of solid material axially to each side of the peripheral flange (34). The flange (34) has a dovetail cross-section having undercuts within which solid material of the plastic septum (50) is disposed forming a seal peripherally around the axial cavity (22). The contact sections (62) extending from the connector may then be subjected to a forming step to define right angles for example, with portions (66) of the contacts (60) embedded with the plastic septum (50) being of irregular cross-section to establish resistance to the stresses of such forming and maintain the sealed nature of the connector (10).

3 Claims, 4 Drawing Sheets

SEALED METAL SHELL CONNECTOR AND METHOD OF MOLDING A PLASTIC INSERT WITHIN A METAL SHELL

FIELD OF THE INVENTION

The present invention is directed to the field of electrical connectors and more particularly to sealed connectors.

BACKGROUND OF THE INVENTION

Certain connectors are known having a molded plastic housing having an array of axial passageways into which are then inserted and retained respective electrical contacts. Where the connector is a pin header fabricated for later connection of the contacts to corresponding contact means of another electrical article such as circuit termini of a circuit board, it may also be important to provide sealing of the passageways about the contacts after insertion and retention by applying an amount of sealant material such as epoxy resin which will then be cured to close off the passageways; sealant application is usually a tedious skill sensitive manual operation even if circular preforms are used which are then melted and cured. For example, when the contacts are to be soldered to circuit termini of a circuit board, it would be desirable to prevent solder flux from wicking along the contacts through the connector to the opposed mating face; flux along the contacts would tend to cause corrosion and would remain after flux cleaning operations if within the plastic housing. Other materials such as conformal coating sprays of dielectric material similarly could wick along the contacts and interfere with assured electrical connections with contacts of a mating connector. One example of such a sealed pin header connector is sold by AMP Incorporated of Harrisburg, Pa. under Part No. 531122-5. It is desirable to provide a sealed pin header which is also rugged.

SUMMARY OF THE INVENTION

The present invention is a sealed pin header having an array of contacts extending through a plate of plastic material which when fabricated is disposed within a metal shell. The metal shell is first machined or cast or otherwise manufactured and has a large axial aperture extending therethrough from one end to the other. The metal shell is then placed in a mold cavity which also is adapted to hold the array of contacts precisely positioned to extend through the metal shell at their final positions, and includes mold cavity wall portions which extend toward each other into the metal shell aperture from one end or both ends, closely adjacent the inner wall surfaces of the metal shell. Appropriate resin is then injected into the mold cavity which consists of the region between the facing surfaces of the wall portions within the metal shell and surrounded by the remaining portions of inner wall surfaces of the metal shell. The molding of plastic about an array of contacts is known, termed "insert molding". The present invention is directed toward modifying general insert molding principles to include molding of a plastic connector portion within a surrounding metal shell of the connector, in addition to molding around the connector contacts.

In conventional molding of plastic, it is known that the molded article will shrink to a certain extent after being molded. In insert molding this shrinkage presents no problem with regard to the contacts extending through a transverse portion of the plastic housing, and the seal about each contact remains after shrinkage. However, were a transverse plastic portion to be molded within a metal shell, the plastic material would shrink away from the inner wall surfaces of the shell and the connector would not be a sealed connector because of the gap between the plastic and metal, necessitating additional means to seal as well as to provide mechanical securing of the plastic within the shell sufficient to withstand stress and strain of further handling and mating with other connectors. To overcome the known shrinkage of plastic material following molding in order to assuredly secure the plastic septum within the shell and to maintain the seal from one end of the connector to the other, a profiled flange is provided on the shell prior to molding, extending inwardly from the inner wall surface of the shell at the axial position of the transverse plastic septum and completely peripherally therearound.

The profiled flange has a cross-sectional shape such as preferably a dovetail which defines undercuts into which the plastic material extends. After molding as the plastic cools, shrinkage of the plastic material within the undercuts establishes a mechanical grip along both sides of the flange peripherally around the inside of the shell for septum retention and simultaneously remains sealed against the flange. By utilizing the shrinkage of the material which occurs naturally, the present invention achieves and maintains an integral seal through the connector from one face to the other between the plastic and the contacts and between the plastic and the shell.

It is an objective of the present invention to provide a connector that is sealed and that is also rugged.

It is also an objective to provide a method of molding plastic within a metal shell which establishes an inherent means of securing the plastic molded portion within the shell following the molding procedure, without other steps or parts.

It is further an objective for such method to establish a seal at the plastic-metal shell joint.

An embodiment of the present invention will now be described by way of example with reference to the accompanying drawings.

DETAILED DESCRIPTION OF THE PREFERRED EMBODIMENT

Figure 1:
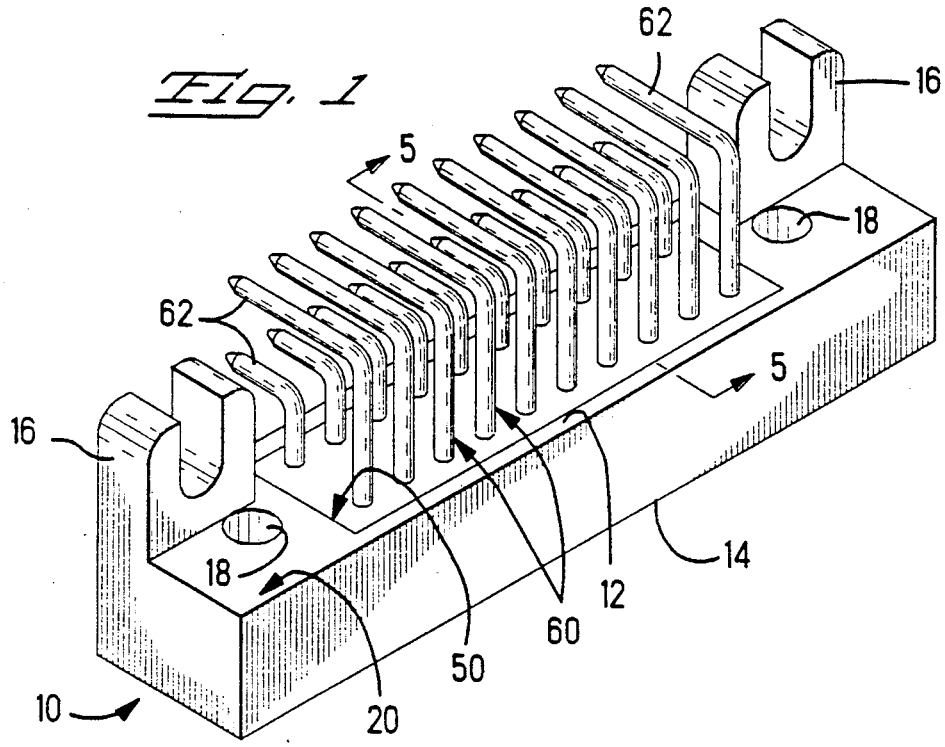
FIG. 1 is an isometric view of an electrical connector of the present invention.

Connector 10 of FIG. 1 has a mounting face 12 and an opposed mating face 14, and includes a metal shell 20, dielectric insert or septum 50 and an array of contacts 60 with first contact sections 62 extending from mounting face 12 and then at right angles. Connector 10 also is shown having a pair of flanges 16 adapted to facilitate connector 10 being secured at a right angle to a circuit board using fasteners (not shown). Apertures 18 would be useful in the mounting of key members (not shown) for keyed mating to a mating connector (not shown) along mating face 14.

Figure 2:
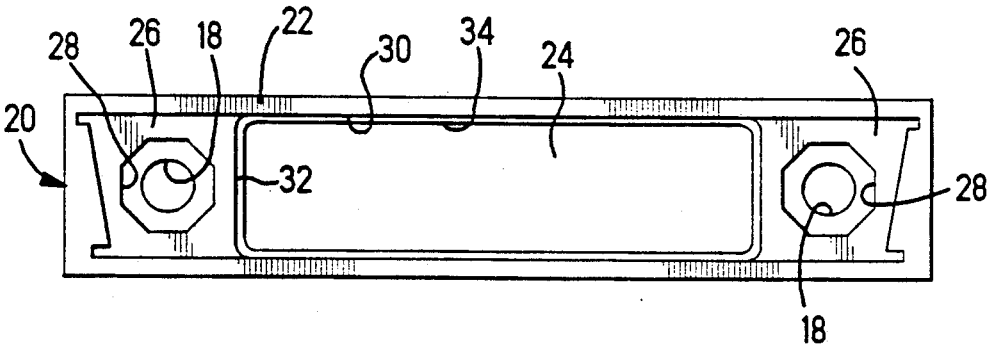
FIGS. 2, 3 and 4 are plan, elevation and cross-sectional views of the metal shell of the connector of FIG. 1 prior to molding.
Figure 3:
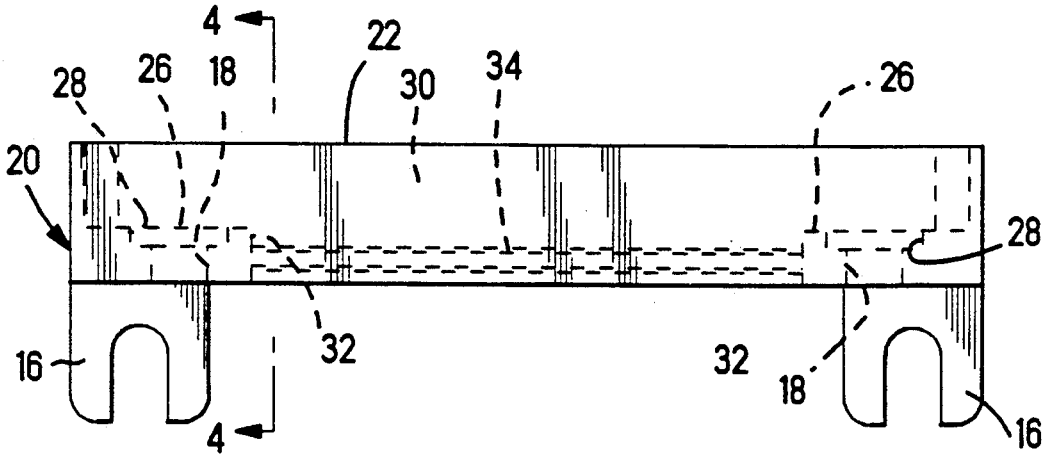
Figure 4:
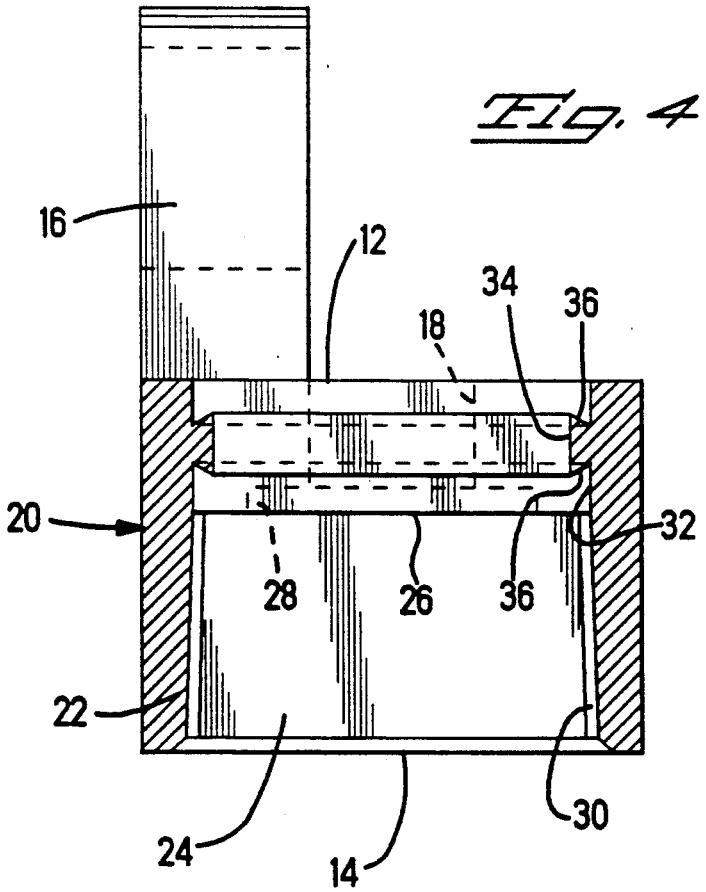

Metal shell 20 as seen in FIGS. 2 to 4 includes a hood section 22 having axially extending walls which extend to a leading edge at mating face 14 and define a large plug-receiving cavity 24 for eventual receipt of a plug portion of a mating connector during mating. At each end of cavity 24 preferably are lands 26 having shaped (such as octagonal) recesses 28 at leading ends of apertures 18 wherein correspondingly shaped portions of key members would be held at selected angular positions upon being mounted therein and then extend forwardly therefrom into cavity 24. Side walls of hood section 22 define inner surfaces 30 which generally extend axially through shell 20 and include a septum region 32 which will be the site ultimately of transverse plastic insert or septum 50 and past which body portions 66 of contacts 60 will eventually extend.

Septum region 32 is adapted to provide for inherent septum retention and sealing by means of flange 34 extending inwardly approximately centrally of the eventual plastic septum and extending peripherally around the entirety of septum region 32. Flange 34 preferably has a dovetail shape in cross-section with undercuts 36 formed along sides of the flange facing toward both mating face 14 and mounting face 12.

Figure 5:
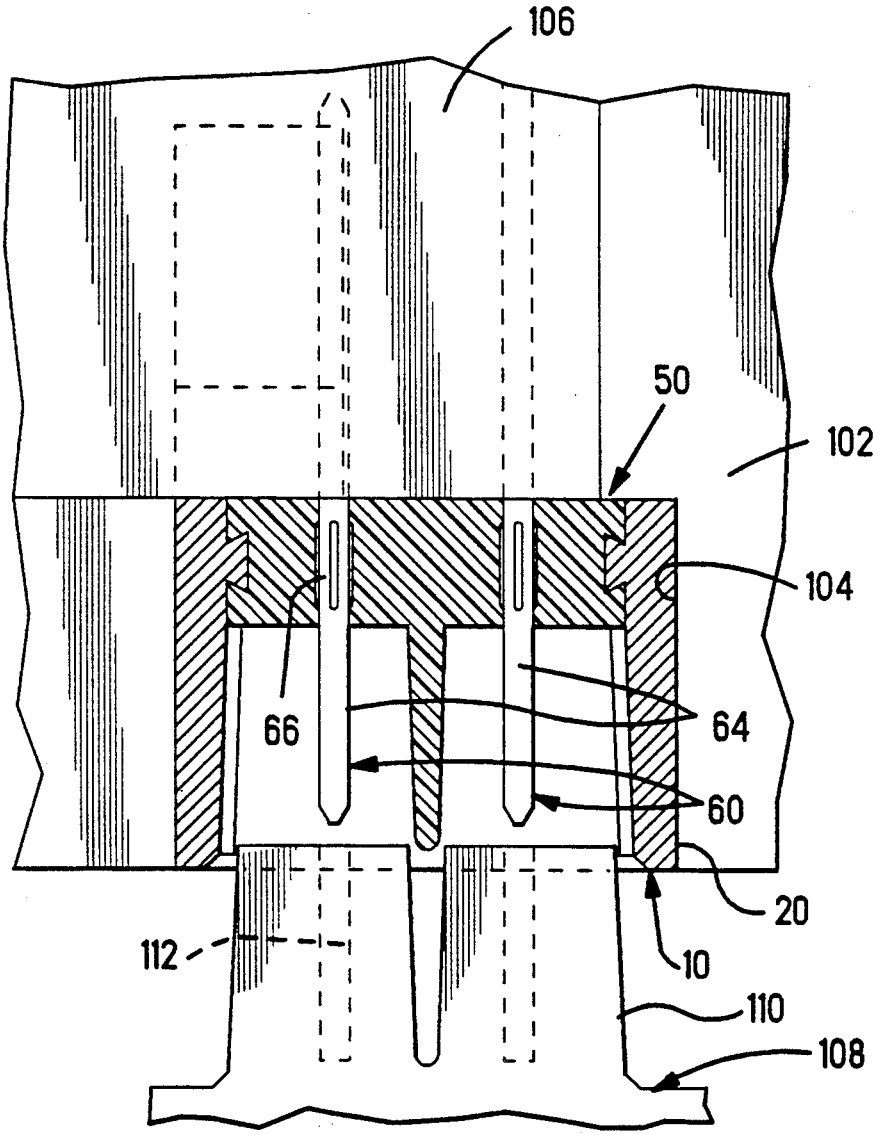
FIG. 5 is a cross-sectional view of the connector after molding of the plastic septum within the shell, showing the mold portions being parted for removal of the connector.

In FIG. 5, plastic septum 50 has been molded within shell 20 at septum region 34, using mold apparatus 100 in one exemplary method. First mold portion 102 includes a large cavity 104 within which had been disposed metal shell 20. Second mold portion 106 is of the type known conventionally to hold the array of contacts 60 in precise positions during the molding process and generally has a surface corresponding to the mounting face of the connector. Third mold portion 108 is adapted to be movable with respect to first mold portion 102 and has a plug portion 110 which is disposed within cavity 24 of shell 20 during the molding process and fits closely with respect to inner surfaces 30 of hood portion 22 of shell 20 and includes passageways fitting closely about second contact sections 64 of contacts 60 which are straight pin sections, and mold portion 108 generally is located along the mating face of the connector. Preferably inner surfaces 30 have an incremental draft together with corresponding incremental drafts of wall surfaces of mold portion 110 thereby permitting withdrawal of mold portion 110 following molding of septum 50. Plastic resin could be injected through sprues in either mold portions 106 or 108 leading to mounting face 12 or the bottom of cavity 24, for example, or could be injected through several small holes (not shown) through shell wall 22 at septum region 32 which holes would remain filled with plastic after molding and would have a negligible effect on the rugged nature of the resulting connector.

Examination of FIG. 5 discloses that molded septum 50 transversely across cavity 24 at septum region 32 will cure to solidify about dovetail-shaped flange 34 and define a mechanical grip thereto which will disallow shrinkage away from the surfaces of the shell member 20, and thus will be retained securely against axial stress and strain as well as define a seal peripherally around septum region 32 of shell 20.

Figure 6:
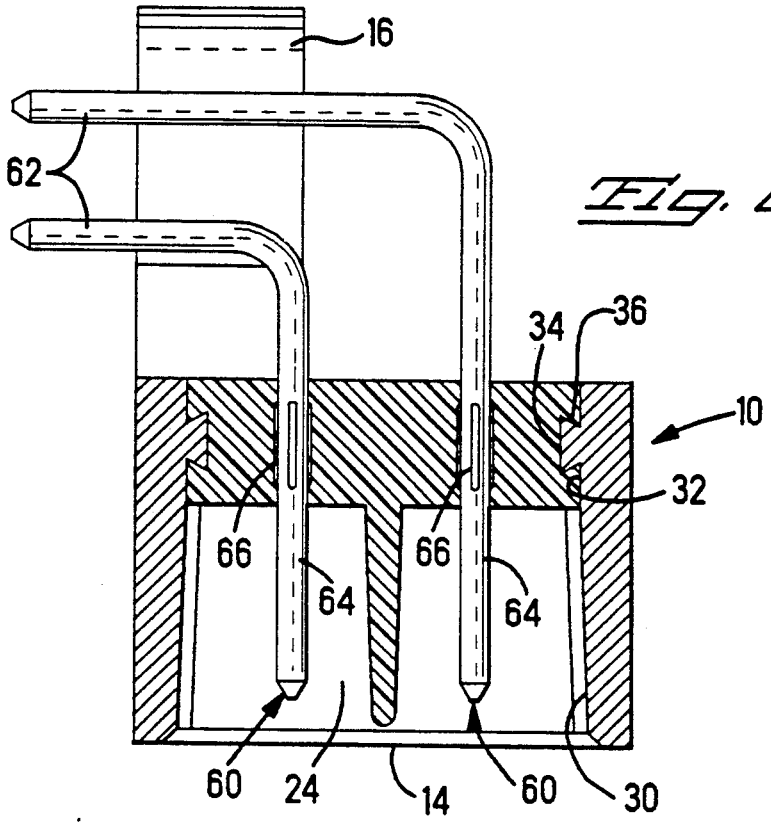
FIG. 6 is a cross-sectional view of the connector of FIG. 5 after forming the contact sections for right angle board mounting.
Figure 7:
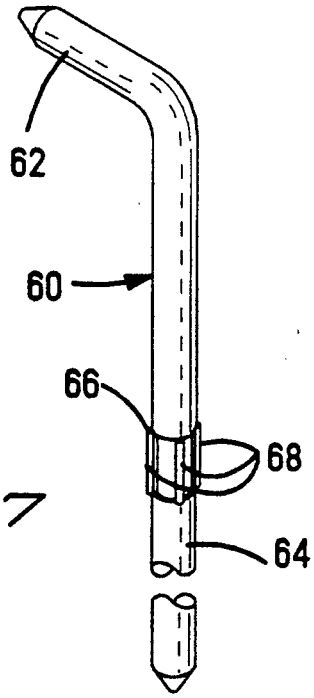
FIGS. 7 and 8 illustrate contacts of the type useful in the connector of the present invention which are round pins having contact sections which are formed at a right angle for right angle through-hole board mounting (FIG. 7) or which are formed into opposed arrays for engagement by board circuit termini at a leading edge of a card inserted therebetween (FIG. 8), both having center sections adapted for insert molding as shown in cross section in FIG. 6.

Contacts 60 seen in FIGS. 5 to 7 (as well as contacts 70 of FIG. 8) all preferably are round pins initially which have first contact sections 62 to be arrayed across the mounting face of connector 10, second contact sections 64 which form an array protected within hood portion 22 of shell 20, and intermediate or body sections 66 therebetween. The portion of body section 66 of each contact preferably is formed by dies into an irregular cross-section such as a four-lobed star to create greater adhesion of the contact to the plastic of the septum following molding, as illustrated in FIG. 6.

Referring to FIGS. 6 and 7, first contact sections 62 have right angle bends for through-hole mounting to a circuit board, with the contacts in one of the rows of contacts being longer than those of the other to be received into a two-row array of through-holes to be soldered. Such right angle bends may be formed after completion of the molding of plastic septum 50, with the first contact sections 62 remaining straight during the insert molding procedure; the array of contacts 60 may be retained on a carrier strip during the molding process, if desired. Such a method is disclosed in U.S. patent application Ser. No. 07/674,279 filed Mar. 21, 1991 and assigned to the assignee hereof.

Figure 8:
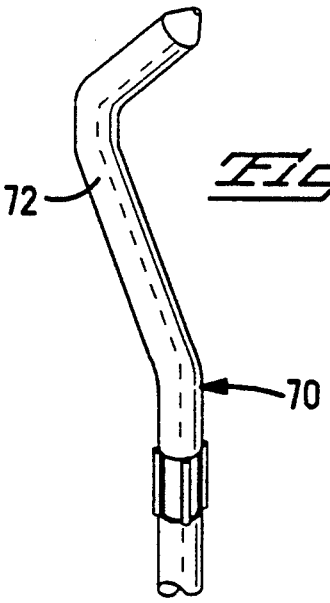

First contact sections 72 of contacts 70 in FIG. 8 have been formed into a generally arcuate shape so that the contacts of opposing rows can be oriented to have the arcuate first contact sections be convex toward each other (preferably with a short flat section at the bottom of the arc) for receipt therebetween of a card edge (not shown) and engage and be soldered to circuit termini along the card surface near the edge, termed straddle mounting. As with contact 60 of FIG. 7 first contact section 72 of contact 70 could be formed after the insert molding of the plastic septum.

Metal shell 20 of connector 10 of the present embodiment can be cast or impact extruded of aluminum and flange 34 then be machined thereinto, or the entire shell could be machined, if desired. Septum 50 can be made using thermoplastic resin such as for example polyester or polyphenylene sulfide. Contacts 60,70 can be extruded for example of copper alloy such as brass which is nickel underplated and gold plated at the second contact sections and tin-lead plated at the first contact sections to enhance soldering.

The benefits of assured retention of a plastic septum within a metal shell are clearly apparent, in that no additional assembly steps or parts are required. The method of the present invention can easily be used beyond the specific connector which is illustrated in the drawings and described herein. The benefits of the particular disclosed connector being sealed occur at least during the soldering of first contact sections 62,72 to circuit boards or cards respectively, which conventionally requires flux; the sealed nature of the connector prevents wicking of solder flux through the septum which could commonly ruin the connector.

Other electrical connectors and indeed other articles could utilize the method of the present invention. Also, contact having square or rectangular cross-sections instead of round, may be used in such connectors. Flange cross-sections of other profiles can be used beyond the preferred one illustrated herein. Modifications can occur to the specific embodiment herein disclosed which are within the spirit of the invention and the scope of the claims.

What is claimed is:

1. An electrical connector of the type having an array of contacts extending through a transverse body portion of plastic, comprising:

a metal shell having an axially extending shell wall defining an axial cavity therethrough and surrounding said transverse body portion of plastic and said array of contacts extending therethrough, said metal shell including a peripheral flange extending inwardly from inwardly facing surface portions of said shell wall located radially around said plastic body portion, said peripheral flange having an axial length less than an axial length of said transverse body portion, said peripheral flange having a dovetailed cross-section thereby having undercuts on both sides thereof;

said transverse body portion being molded about body sections of said contacts of said array and within said metal shell to extend transversely across said axial cavity between said inwardly facing surface portions, and being molded to form solid material upon curing axially to each side of said peripheral flange and within said undercuts peripherally around said transverse body portion, whereby said transverse body portion is retained within said shell and stopped against axial movement with respect thereto by said solid material axially to each side of said peripheral flange and forms a seal with said shell walls at said peripheral flange and a seal with said contacts at said body portions thereof.

2. The electrical connector as set forth in claim 1 wherein said body portions of said contacts include asymmetric cross sections embedded within said transverse body portion of plastic, thereby preventing even incremental rotation of said contacts within said transverse body portion upon subjection to stress, and maintaining said seal.

3. A method of fabricating an article having a plastic insert within a metal shell, comprising:

forming a metal shell having a circumferentially continuous shell wall enclosing an axially extending cavity therethrough to have an insert region defined between a periphery of inwardly facing surface portions of said axially extending shell wall at a selected axial location, including forming a peripheral flange extending inwardly from said surface portions a selected distance having an axial length less than an axial length of said insert region, said flange tapering to define undercuts axially along each side thereof; and molding within said metal shell at said insert region a transverse septum of plastic to embed said peripheral flange, whereby said septum upon curing and cooling establishes solid material axially to each side of said peripheral flange and within said undercuts, minimizing shrinking transversely from said inwardly facing surface portions of said shell wall and preventing axial movement of said septum when subjected to stress or strain.

* * * * *